United States Patent [19]

Banfi

[11] Patent Number: 4,535,731

[45] Date of Patent: Aug. 20, 1985

[54] DEVICE FOR AUTOMATICALLY VARYING THE TIMING OF A CAMSHAFT

[75] Inventor: Ambrogio Banfi, Milan, Italy

[73] Assignee: Alfa Romeo Auto S.p.A., Naples, Italy

[21] Appl. No.: 491,705

[22] Filed: May 5, 1983

[30] Foreign Application Priority Data

May 17, 1982 [IT] Italy ..... 21313 A/82

[51] Int. Cl.[3] ..... F01L 1/34

[52] U.S. Cl. ..... 123/90.15; 123/90.17

[58] Field of Search ..... 123/90.15, 90.17, 90.55

[56] References Cited

U.S. PATENT DOCUMENTS 2,191,459 2/1940 Duncan ..... 123/90.17
3,258,937 7/1966 Kranc et al. ..... 123/90.15 X
3,978,829 9/1976 Takahashi et al. ..... 123/90.15
4,231,330 11/1980 Garcea ..... 123/90.15

FOREIGN PATENT DOCUMENTS 121314 9/1979 Japan ..... 123/90.55

*Primary Examiner*—Michael Koczo
*Assistant Examiner*—Peggy A. Neils
*Attorney, Agent, or Firm*—Charles A. Brown; Charles E. Brown

[57] ABSTRACT

This invention relates to a device for automatically varying the timing of a camshaft relative to the drive shaft of an internal combustion engine, comprising an axially slidable splined sleeve which connects the camshaft to its drive pulley, and is operated by the engine lubricating oil in such a manner as to change the angular position of said camshaft by way of valve means controlled by an electromagnetic actuator as a function of at least one engine parameter.

4 Claims, 2 Drawing Figures

DEVICE FOR AUTOMATICALLY VARYING THE TIMING OF A CAMSHAFT

In internal combustion engines, the intake and exhaust valves are known to open immediately before the commencement of the piston intake or exhaust stroke, and close immediately after termination of said intake and exhaust stroke. In this manner, the valves are completely open at the beginning and end of the respective stroke, to allow proper filling of the cylinders with fresh mixture, and effective expulsion of the gaseous products of combustion.

Consequently, straddling the T.D.C. between the end of the exhaust stroke and beginning of the intake stroke of any one piston there occurs the so-called cross-over in which the exhaust valves and intake valves are simultaneously open. Under these conditions, backward flow of part of the exhaust gas from the explosion chamber or from the exhaust duct into the intake duct can occur, either because of the vacuum existing in said exhaust duct when the throttle valve is rather closed, and/or because of the back-pressure present in the exhaust duct. The consequence of this backward flow is a lesser filling of the cylinders and thus a lower engine efficiency.

However, under cross-over conditions there can also be a positive pressure difference between the intake duct and exhaust duct, when the throttle valve is very open, and because of the inertia of the fluid column present in the intake duct and exhaust duct it can happen that the air or the fresh mixture scavenges the explosion chamber, so increasing cylinder filling and consequently improving the engine efficiency.

Thus in order to optimise engine operation, it would be necessary to provide modest cross-overs for small throttle valve openings, and large cross-overs for large throttle valve openings, whereas in the case of fixed timing of the intake and exhaust valves, the efficiency can be optimised only for determined engine speeds.

However, the ideal method involving the continuous variation of the valve timing with the different engine operating conditions is rather complicated in practice, and those methods which allow operation with certain prechosen timing values, each optimised for a particular region of the range of operation of the engine, have proved easier to effect and also somewhat advantageous.

There already exist devices of this type particularly suitable for engines with overhead camshafts, which allow automatic variation of camshaft timing relative to the drive shaft. Of the many types, one which has proved particularly functional is a device formed by disposing an axially mobile connection sleeve between the camshaft drive pulley and the camshaft itself, and connecting said sleeve to the one and the other by means of splined couplings comprising straight teeth and helical teeth. An annular piston which can be operated by the pressurised oil used for lubricating the engine is rigid with the sleeve, so that different timings of the camshaft relative to the drive shaft correspond with the different axial positions assumed by said sleeve.

In these devices, the feed or discharge of the oil for operating the annular piston is controlled by valves operated mechanically as a function of a prechosen engine parameter, for example the engine rotational speed as determined by a centrifugal sensor, or the angular position of the feed throttle valve.

These known devices, in which the valves are operated mechanically, allow only timing variation relationships which are fairly simple and linear to be attained, and are therefore not very versatile. In addition, they are not suitable for providing a wide range of variation of the timing, both because of their bulk and, in particular, because of the constraints imposed by the arrangement of the parts.

The object of the present invention is an improvement in timing variation devices of the described type, which obviates the limitations of known devices.

According to the invention, the valve means which control the feed and discharge of the oil for operating the annular piston are operationally connected to an electromagnetic actuator, which receives a command for closing said valve means in the form of an electric signal emitted by a central electronic unit able to process the signals fed by sensors of prechosen engine parameters.

A device constructed in this manner is very precise and reliable even though it is able to effect even complicated timing variation relationships, as a function of one or more engine parameters, as will be apparent by examining the accompanying FIGS. 1 and 2, which show two preferred embodiments of the invention by way of non-limiting example.

Figure 1:
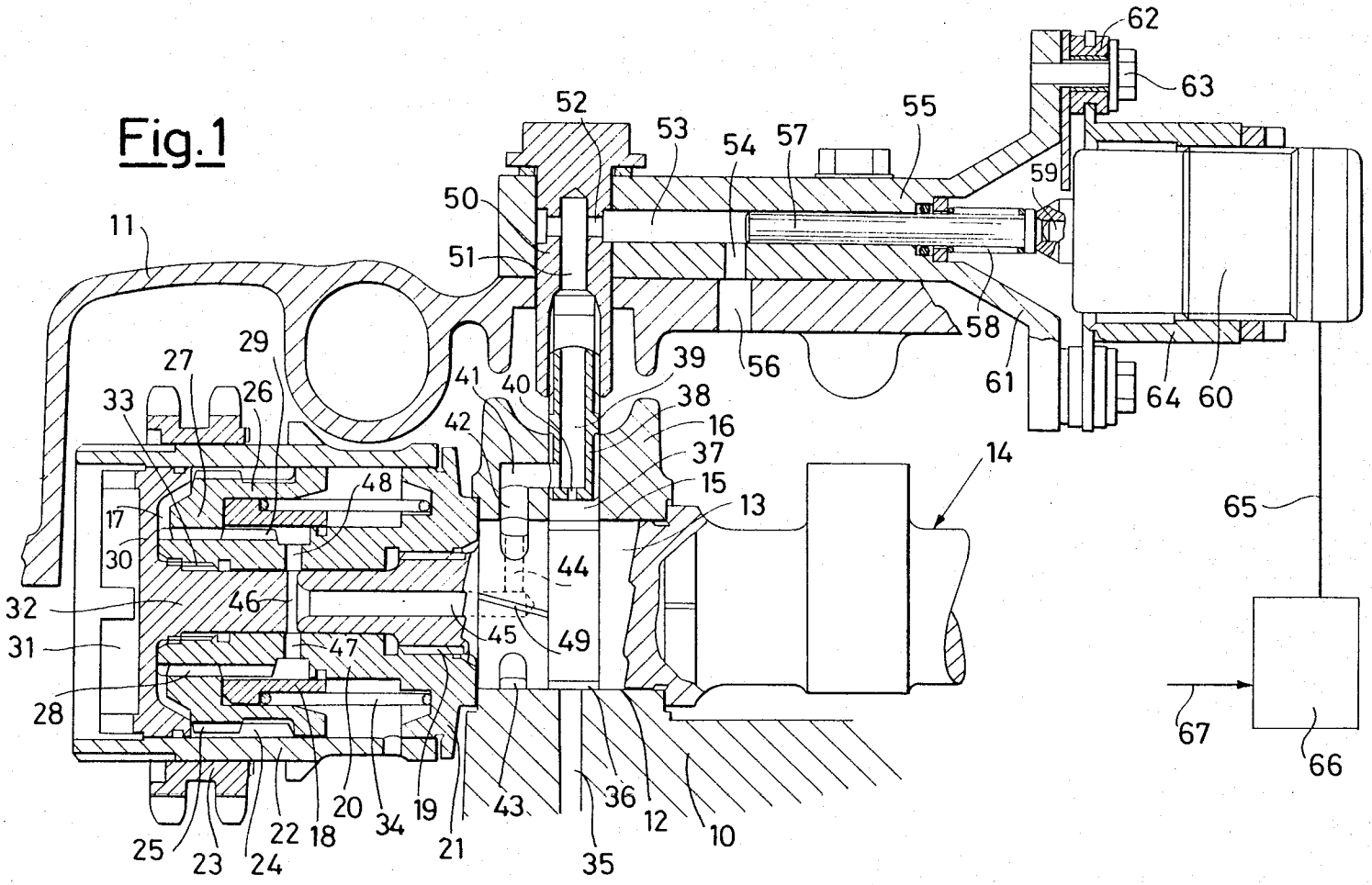
FIG. 1 is a view, partly in axial section, of one embodiment of the device.

In FIG. 1, the reference numeral 10 indicates the partly shown cylinder head of an internal combustion engine, and 11 indicates the cylinder head cover. The cylinder head comprises the half bearing 12 which supports the journal 13 of the camshaft 14, which is also shown partly. The other half bearing 15 supporting the journal 13 is formed in the cap 16.

A hollow pin, indicated by 20, is made rigid with the shaft 14 by means of the screwed connection 19, and is provided at one end with the flange 21 on which the tubular member 22 is mounted. The toothed pulley 23 is made rigid with the tubular member 22 in known manner, and is rotated by the drive shaft by means of a chain, not shown.

The tubular member 22 is provided with a clutch 24 with internal toothing of the straight toothed type, with which there engages corresponding toothing 25 of a sleeve 26 rigid with an annular piston 27, and also carrying toothing of the helical toothed type indicated by 28, which engages with a corresponding clutch 29 with external toothing, provided on the hollow pin 20.

The reference numeral 30 indicates a circular plate fitted with a notched ring 31 for gripping purposes, and provided with a pin 32 which is made rigid with the hollow pin 20 by means of the screwed connection 33.

The reference numeral 34 indicates a preloaded spring disposed between the flange 21 and the ring 18 inside the sleeve 26.

The cylinder head 10 is provided with the duct 35 for feeding lubricating oil to the half bearings 12 and 15 by way of the annular cavity 36. The cap 16 comprises a threaded bore 37 into which is screwed the stud 38, provided with a through bore 39 for conveying the oil to discharge. The presized orifice 40 provided for maintaining the lubricating oil to the half bearings 12 and 15 under pressure, is inserted into the bore 39.

The cap 16 is also provided with the bores 41 and 42, which connect the bore 39 to a semi-annular cavity 43 provided in the pin 13. The cavity 43 communicates by way of the radial bore 44 with the longitudinal bore 45 provided in the shaft 14. The oil present in the bore 39 can thus pass into the cavity 46, into the bores 47 and 48, and through the spaces between the teeth of the clutches 28 and 29, to reach the annular chamber 17 and the face of the annular piston 27.

The figure shows the channel 49 which distributes the pressurised oil in the left hand region of the half bearings, where the pressure would be lacking due to the presence of the semi-annular cavity 43, which being connected to the discharge bore 39 contains oil at atmospheric pressure, except when the discharge is shut off.

The connector 50, which is supported in the cylinder head cover 11, is screwed onto the stud 38. The connector 50 is provided with oil bleed bores 51 and 52 which communicate with the outside through the bores 53 and 54 provided in the plate 55, and through the bore 56 provided in the cover 11.

The slide valve element 57, for shutting-off the bleed bore 54, is mounted slidably in the bore 53. The valve element 57 leaves the bleed bore 54 open when held back by the spring 58.

It should be noted that the bore 41 for the entry of oil to the feed circuit for the chamber 17 and annular piston 27 branches from the downstream side of the presized orifice 40, so that in said circuit the pressure is atmospheric while the bleed bore 54 is open, and increases to assume the value in the duct 35 only when said bore 54 is closed.

The valve element 57 can be engaged by the mobile armature 59 of an electomagnetic actuator 60, which is supported by the bracket 61 rigid with the plate 55 by way of the rubber ring 62, bolts 63 and the cylindrical casing 64.

The coil of the electromagnet 60 is connected by the conductor 65 to a central electronic unit represented by the block 66 and constituted for example by a unit comprising comparators able to process the signals fed by sensors of prechosen engine parameters, such as the angular position of the feed throttle valve, the vacuum at the engine intake, the engine rotational speed, and the intake air throughput.

In this particular case, the engine parameter used by the central unit 66 to form the electromagnet control signal is the angular position of the throttle valve, represented by the arrow 67.

The central unit 66 feeds no control signal to the electromagnet 60 while the indication of the angular position of the throttle valve, represented by the arrow 67, is less than a predetermined threshold value. In this case, the electromagnet is unenergised, and the armature 59 remains in its withdrawn position as shown in FIG. 1, the valve element 57 is held back by the spring 58, and the bore 54 remains open to connect to atmosphere the circuit (41, 42, 43, 44, 45, 46, 47, 48) for feeding oil to the chamber 17 and to the annular piston 27.

Under these conditions, the sleeve 26 is urged by the spring 34 into its end position shown in FIG. 1, and is rotated by the toothed pulley 23 by way of the coupling formed by the straight teeth 24 and 25, to in its turn rotate the camshaft 14 by way of the coupling formed by the helical teeth 28 and 29, to provide a determined initial timing between the camshaft and toothed pulley 23.

The central unit 66 feeds a signal for causing the energising of the electromagnet 60 when the indication of the angular position of the throttle valve (arrow 67) exceeds a predetermined threshold value. As a result of the energising of the electromagnet, the armature 59 is thrust outwards and acts on the actuator 57 in the sense of closing the bleed bore 54.

In the oil feed circuit (41–48) to the annular piston 27, the pressure increases and assumes the value existing in the duct 35, when the bleed bore 54 is completely closed. The pressurized oil then acts on the annular piston 27 with a force which succeeds in overcoming the preloading of the spring 34, and urges the sleeve 26 towards the right (in FIG. 1).

The axial movement of the sleeve 26, allowed by the coupling provided by the straight teeth 24 and 25, leads to a corresponding rotation of the hollow pin 20 by virtue of the presence of the coupling formed by the helical teeth 28 and 29. Consequently, the angular position of the camshaft 14 varies relative to the toothed pulley 23, and thus the timing of the camshaft is changed relative to the drive shaft. If the camshaft 14 is for example that which controls the exhaust valves of an engine with overhead camshafts, a variation is attained in the cross-over, for example an increase, between the intake valves and exhaust valves, when the opening of the throttle valve exceeds a predetermined value.

The control signal for the electromagnet 60 can also be provided by the central unit 66 as a function of the combination of several suitably chosen engine parameters.

In addition, if necessary, the electromagnet armature 59 and the valve element 57 can be connected together by way of a linkage, for example a rocker arm, in order to obtain force amplification.

Figure 2:
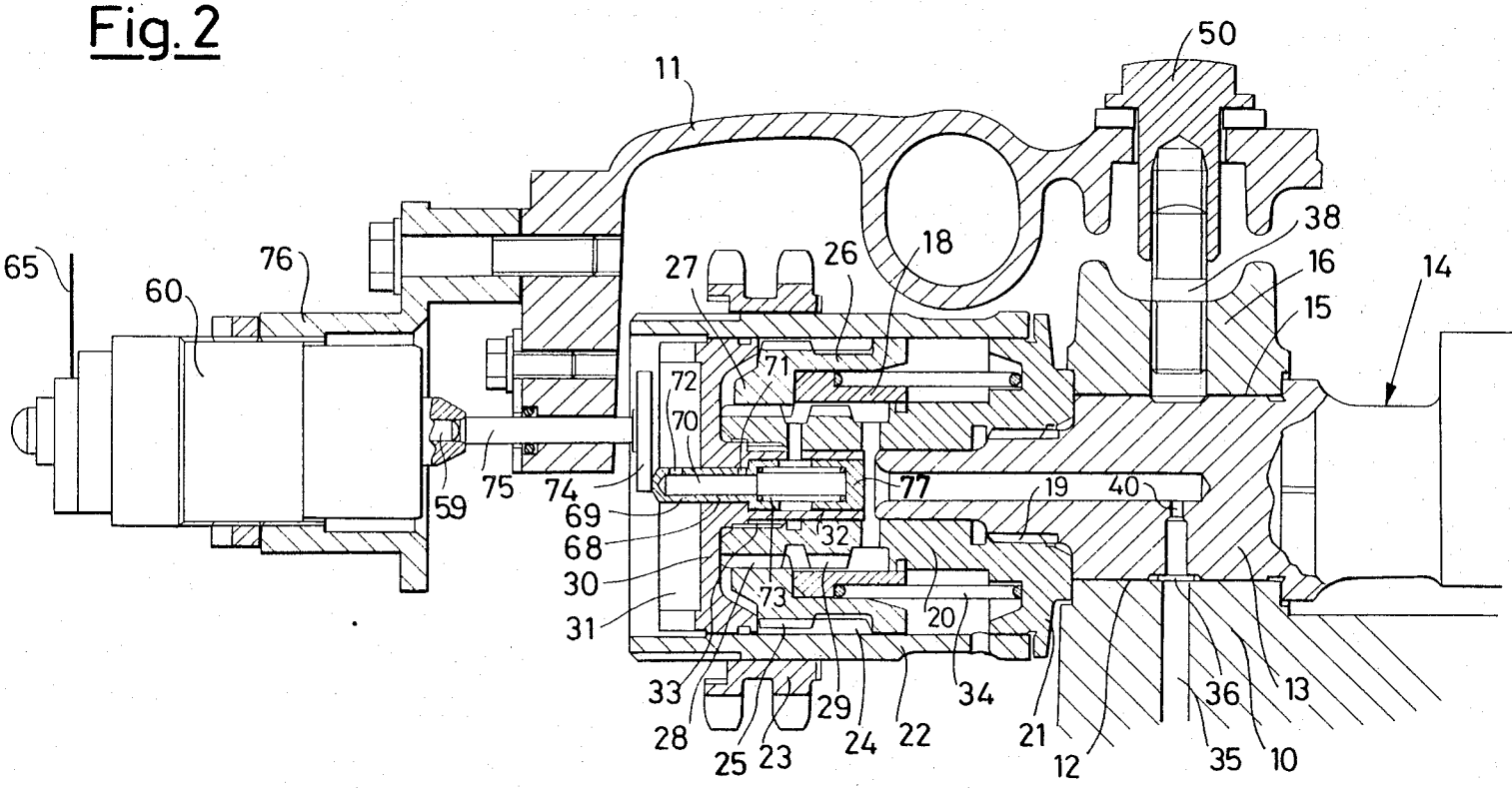
FIG. 2 is a view, partly in axial section, of a second embodiment of the device.

FIG. 2 shows a modification of the device illustrated in FIG. 1, the common elements being indicated by the same numerals.

In this case, the stud 38 is solid, and the connector 50 is without bleed bores, while the plate 30 is in the form of a disc and the pin 32 rigid therewith is hollow. In its internal bore 68 there is disposed a slide valve element indicated by 69, provided with a longitudinal dead bore 70 and radial bleed bores 71 and 72. On the slide valve element 69 there acts a preloaded spring indicated by 73, which rests against a plug 77 and urges the valve element against the disc 74, which is rigid with a rod 75 slidable in a sealed manner in the wall of the cover 11.

The rod 75 can be engaged by the armature 59 of the electromagnetic actuator 60, which is also supported by the cover 11 by means of the bracket 76.

The device shown in FIG. 2 operates as that shown in FIG. 1. While the slide valve element 69 is in a position pushed out of the bore 68 by the spring 73, the oil fed by the duct 35 is discharged to the outside through the bores 70 and 72. Under these conditions, the camshaft assumes a determined initial timing relative to the toothed pulley 23.

When the armature 59 of the electromagnet 60 is urged outwards, the slide valve element 69 is pushed into the bore 68, so shutting-off the bleed bore 72. The pressurised oil then acts on the annular piston 27 in order to vary the timing of the camshaft 14 relative to the toothed pulley 23.

I claim:

1. A device for automatically varying the timing of a camshaft relative to the drive shaft of an internal combustion engine, the camshaft being supported by bearings lubricated by pressurized oil of the engine lubrication circuit, the camshaft being driven in timed relation with the drive shaft by a toothed pulley rigidly affixed with a tubular member, the device comprising a sleeve movable axially within the tubular member in order to connect the toothed pulley to the camshaft, the sleeve being constrained to the tubular member by means of a straight toothed splined connection and being constrained to the camshaft by means of a helical toothed connection, an annular piston being rigidly affixed with the sleeve, a circular plate being rigidly affixed with the camshaft, the circular plate with the tubular member and the annular piston forming a chamber, the chamber being integrally connected to the engine lubrication circuit which feeds the pressurized oil to the camshaft support bearings by passage means for permitting oil to flow to the chamber, a presized orifice in said passage means for controlling the rate of oil flow to said chamber, vent means coupled to said passage means downstream of said presized orifice for communicating the passage means to atmosphere, said vent means including axially movable valve means for opening and closing said vent means and thereby regulating the feed and discharge flow of oil through the passage means, said vent means being normally open to allow the discharge of oil from said chamber, the axially movable valve means being operationally connected to an electromagnetic linear actuator which receives a command in the form of an electric signal from an electronic central unit in response to signal received from prechosen engine parameter sensors whereby the axially movable valve means moves to close the vent means causing oil to flow to the chamber.

2. A device as claimed in claim 1, characterized in that the electromagnetic actuator is provided with a mobile armature which moves axially outwards when the electromagnetic actuator is energized.

3. A device as claimed in claim 1 wherein the axially moveable valve means is a slide valve element and includes elastic means for retaining the slide valve element in said normally open position whereby the vent means is vented to atmosphere and oil will be discharged from the chamber.

4. A device as claimed in claim 1 wherein the axially movable valve means is a slide valve element and the vent means forms an integral part of the slide valve element.

* * * * *